United States Patent [19]

Maglica

[11] Patent Number: 5,003,440

[45] Date of Patent: Mar. 26, 1991

[54] TAILCAP INSERT

[75] Inventor: Anthony Maglica, Ontario, Calif.

[73] Assignee: Mag Instrument, Inc., Ontario, Calif.

[21] Appl. No.: 353,008

[22] Filed: May 17, 1989

[51] Int. Cl.[5] ..... F21L 7/00; F21V 31/00

[52] U.S. Cl. ..... 362/158; 362/202; 362/207; 362/267

[58] Field of Search ..... 362/197, 202, 205, 207, 362/208, 267, 310, 373, 158

[56] References Cited

U.S. PATENT DOCUMENTS

| | | | |
|---|---|---|---|
| 4,237,526 | 12/1980 | Wood | 362/158 |
| 4,327,401 | 4/1982 | Siiberg | 362/205 X |
| 4,348,715 | 9/1982 | Christensen et al. | 362/205 X |
| 4,433,366 | 2/1984 | Wade | 362/158 X |
| 4,819,141 | 4/1989 | Maglica et al. | 362/207 |
| 4,823,242 | 4/1989 | Maglica et al. | 362/205 X |

FOREIGN PATENT DOCUMENTS

| | | | |
|---|---|---|---|
| 269323 | 6/1988 | European Pat. Off. | 362/158 |
| 812980 | 5/1959 | United Kingdom | 362/202 |
| 884212 | 12/1961 | United Kingdom | 362/202 |

*Primary Examiner*—Stephen F. Husar
*Assistant Examiner*—Peggy Neils
*Attorney, Agent, or Firm*—Lyon & Lyon

[57] ABSTRACT

The flashlight having a conductive barrel and a tailcap insert which provides for enhanced mechanical and electrical contact between the barrel and the batteries, provides for retaining a tailcap spring to the tailcap upon removal of the tailcap from the barrel, provides retainers to prevent the tailcap insert contacts from over radial extension and/or provides a one-way flow seal to permit outflow of gases produced during flashlight operation but to prevent ingress of material from ambient to within the battery housing.

17 Claims, 2 Drawing Sheets

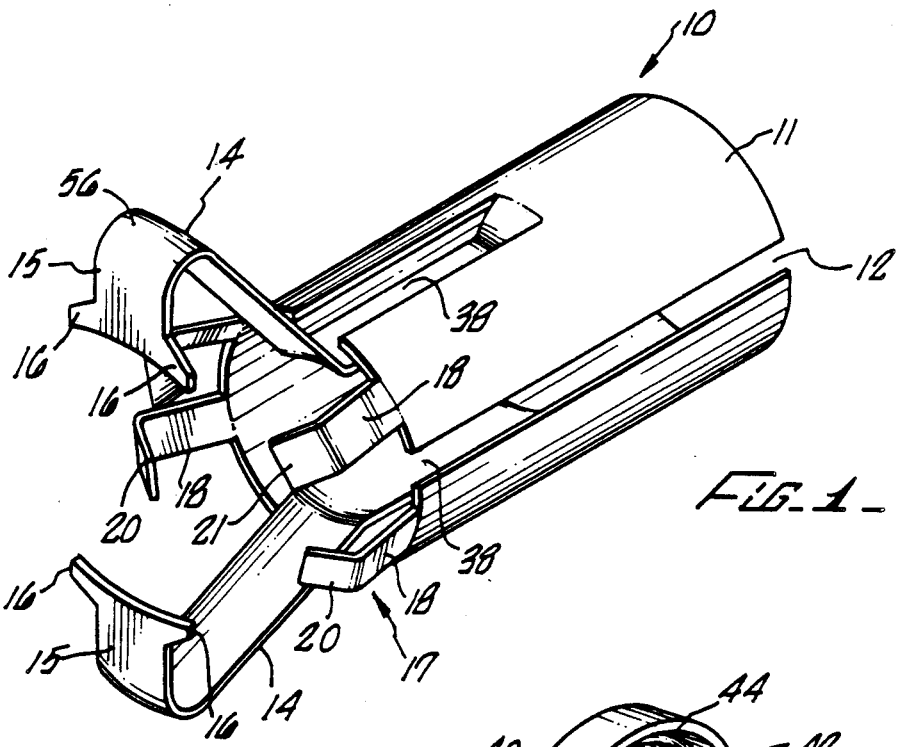
FIG. 1
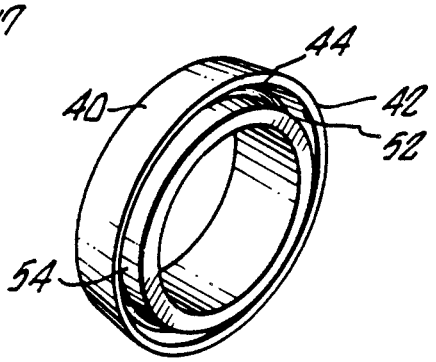
FIG. 2
FIG. 3
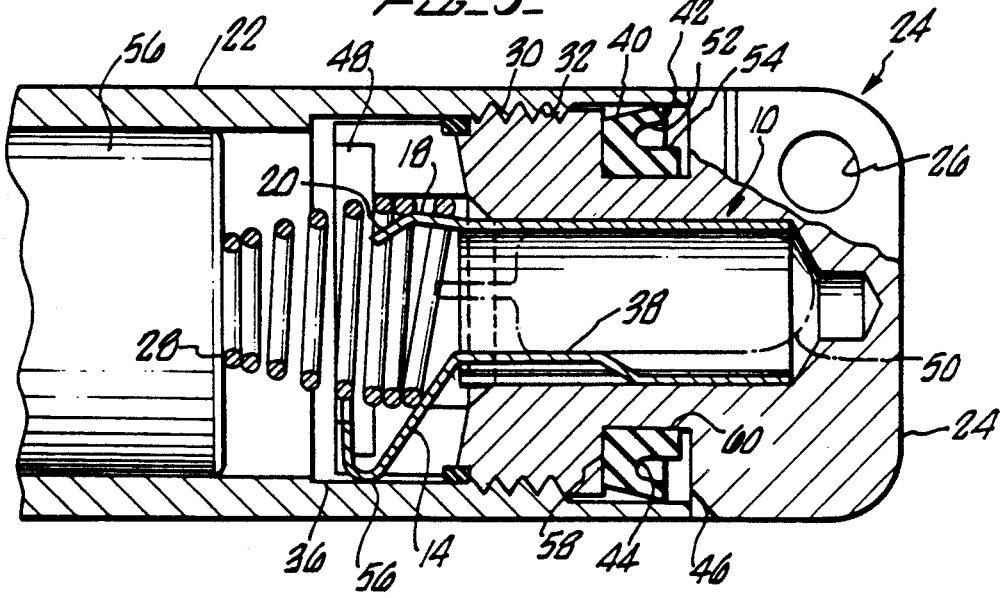

TAILCAP INSERT

BACKGROUND OF THE INVENTION:

1. Field of the Invention

The present invention relates primarily to flashlight improvements, and in particular, to hand-held flashlights having a tailcap insert of the type generally disclosed in U.S. Pat. No. 4,819,141, and/or to a flashlight having an improved seal to permit flow of out gasses from the interior of the flashlight to ambient while preventing ingress of foreign material into the flashlight battery compartment.

2. Discussion of the Prior Art

Flashlights of varying sizes, shapes and power supplies are well-known, including flashlights having a tailcap insert of the type shown in U.S. Pat. No. 4,819,141. In general such flashlights incorporate inserts of this general type in order to eliminate several machining steps during manufacture of the flashlight and to maintain a high degree of electrical continuity within the electrical circuit in the tailcap region of the flashlight. It has been observed that with known tailcap inserts of the type shown in U.S. Pat. No. 4,819,141 the lateral forces exerted on wings of the insert are sometimes insufficient to exert a tight mechanical fit between the wings and the inside surface of the barrel at the tailcap end of the flashlight.

Also, it has been found that the indents in such a tailcap insert did not always provide for secure holding of the spare lamp which is normally kept within the central bore of the tailcap.

Also, the tailcap inserts of the general type disclosed in U.S. Pat. No. 4,819,141 may permit the tailcap spring to become loose, upon removal of the tailcap, from the barrel during battery and/or lamp replacement.

Conventional flashlights also are known to produce gases during normal operation of their enclosed batteries. One of the problems associated with conventional flashlights is inadequate provision for the flashlight to permit release of excess gases produced during the normal operation of the flashlight. Although many conventional flashlights are effectively sealed through the combination of close mechanical tolerances at closure points and through strategically placed 0rings or equivalent seals, such seals effectively prevent not only ingress of contaminants, but also prevent the escape of gases produced during normal operation of the flashlight, and, therefore, may permit undesirable gas build up within the flashlight battery compartment.

The present invention seeks to improve the flashlight art in accordance with the hereinafter stated objects of the present invention.

OBJECTS OF THE INvENTION

It is an object of the present invention to provide a hand-held flashlight having a tailcap insert having enhanced ability to form and maintain effective electrical circuit continuity near the tailcap end of the flashlight from a battery to the conductive barrel of the flashlight.

It is another object of the present invention to provide a hand-held flashlight having a one-way seal which permits the outflow of gases from the interior of the flashlight battery compartment to ambient but which prevents ingress of foreign materials into the battery compartment of the flashlight.

It is a further object of the present invention to provide a tailcap insert having improved spare lamp retainer capabilities.

It is a further object of the present invention to provide a tailcap insert having an improved ability to retain the tailcap spring attached to the tailcap insert upon removal of the tailcap from the barrel.

It is a further object of the present invention to provide a means by which the radially extending, outermost wing portions of the tailcap insert are retained from radial extension beyond a certain predetermined distance from the centerline in order to prevent over extension and possible bending or breaking.

It is a further object of the present invention to provide a hand-held flashlight having provision for accomplishing any combination of the above stated objectives.

These above stated and other objects of the present invention, which may become obvious to those skilled in the art from the hereinafter detailed description of the preferred embodiments of the invention, may be achieved by a flashlight according to the present invention.

SUMMARY OF THE INVENTION

The present invention is directed to a flashlight having at its tailcap an improved tailcap insert and/or a one-way flow seal.

One embodiment of the tailcap insert of the present invention provides a generally cylindrical, electrically conductive tube having generally upwardly and outwardly extending contact leaf fingers, or wings, extending from the forward end of the insert and positioned to be forced radially outward against the barrel inner wall in response to a compressive force exerted by the tailcap spring upon insertion of batteries and subsequent assembly of a flashlight.

The present invention may also include at the forward end of the tailcap insert a plurality of angled tailcap spring retainer leaves extending generally forwardly and outwardly from the forward end of the tailcap insert and then forwardly and inwardly as well as sized and positioned to capture and retain a conical tailcap spring of a flashlight.

The tailcap insert of the present invention may also contain on distal end portions of each contact leaf a pair of symmetrical, mutually opposed, spaced apart contact leaf retainer fingers which function to prevent over radial extension of the contact leaves during times when the tailcap assembly has been removed from the barrel.

The present invention may also include a one-way flow seal made of a flexible material of a generally donut shaped configuration, but having a rearwardly facing channel and an inner wall and outer wall and placed at the interface between the tailcap and barrel whereby gases contained within the battery compartment of the flashlight maybe passed out through the seal but ingress of foreign materials through the seal and into the body of the flashight is prevented. The seal feature also includes one or more vents positioned at the interface between the barrel and tail cap.

BRIEF DESCRIPTION OF THE DRAWINGS

FIG. 1 is a foreshortened, front perspective view of the tailcap insert of the present invention.

FIG. 2 is a rear perspective view of the one-way flow seal of the present invention.

FIG. 3 is a cross-sectional view of the tailcap end of a flashlight incorporating the present invention, taken along lines A—A and, in pertinent part, B-B of the tailcap insert of FIG. 1 and the one-way flow seal of the present invention.

DETAILED DESCRIPTION OF PREFERRED EMBODIMENTS

Figure 5:
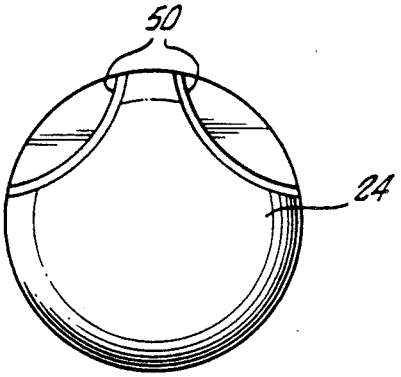
FIG. 5 is a rear view of a preferred tailcap incorporating the presently disclosed inventions.

In flashlights of the general type shown in U.S. Pat. Nos. 4,577,263 and 4,658,336, advantageous use is made of a tailcap insert of the general type shown in U.S. Pat. No. 4,819,141. Although the present invention may be used with virtually any size and type of flashlight, the following descriptions relate to uses in flashlights of the type set forth in the above-referenced patents.

Referring to FIGS. 1 and 3, a tailcap insert 10 is shown. The tailcap insert 10 has a generally tubular shaped body 11 having a longitudinal slot 12 formed along one side of its length thereof and a plurality of contact leaves 14 and spring retainers 17 at its forward end. The slot functions to provide ease of manufacturing from a single, thin sheet of material and to provide for variable closing radii in order to place the insert 10 into the central bore of the tailcap 22. The contact leaves 14 function to provide an electrically conductive path between the battery 56 and barrel 22 of a metal flashlight.

The tailcap insert 10 of the present invention may be made of any suitable conventional conductive material, such as for example, beryllium copper, or other materials which provide good electrical conductivity as well as good mechanical strength.

Referring to FIG. 2, a rear perspective view of the one-way flow seal 40 of the present invention is shown. Inner channel 44 extends into the body of the generally donut shaped 40 seal and channel 44 has a radially outer wall 52 and a radially inner wall 54. The channel outer wall 52 together with its adjacent region forms flexible portion 42 of the one-way flow seal 40, as will hereinafter described more fully. The channel 44 is shown facing to the tailcap; however, it is noted that an important feature of the channel is that it faces away from the battery compartment.

Figure 4:
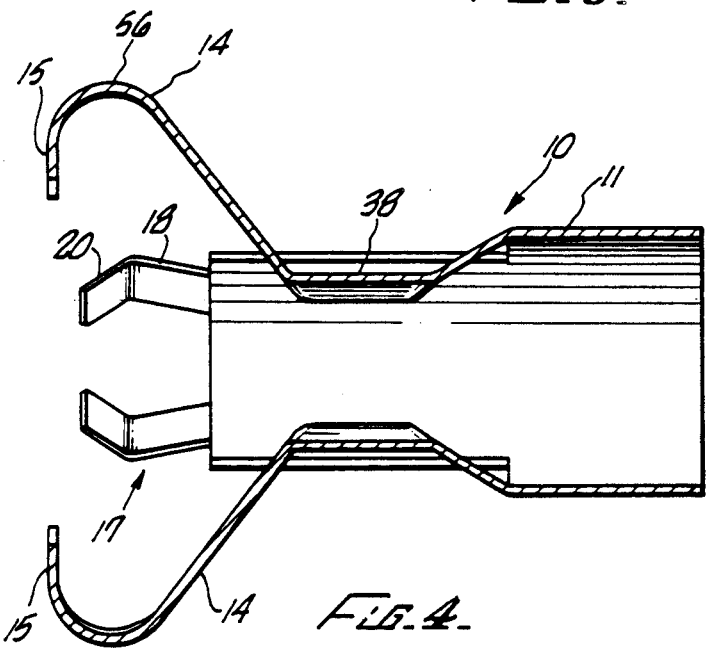
FIG. 4 is a cross-sectional view of the FIG. 1 tailcap insert taken along lines A-A, and in pertinent part, B-B of the FIG. 1 insert.

In a preferred embodiment, the tailcap insert 10 has two contact leaves 14, 14 as shown in FIGS. 1, 3 and 4. Each contact leaf 14 extends from the main body portion of the tailcap insert 10 first inwardly at contact leaf lamp retainer portions 38, 38 and then outwardly and forwardly at wing portion 56. The mutually opposed contact leaf lamp retainer portions 38, 38 will, upon insertion of the tailcap assembly into a barrel having batteries, cause a force to be applied against spare lamp 50 sufficient to securely contain the lamp within the central cavity of the tailcap 24. The main portion, or wings, of the contact leaves 14, 14 then extend forwardly and radially outward to a predetermined maximum radial distance from the tailcap central bore centerline and its distal end portions 15 then curve in towards the central bore centerline to terminate at contact leaf retainer fingers 16, 16. Each contact leaf 14 has two contact leaf retainer fingers 16, 16 at its distal end. The contact leaf retainer fingers 16, 16 butt up against the inside surface of tailcap counterbore 48, as shown in FIG. 3 and thus prevent radial extension of the contact leaves 14, 14 beyond a predetermined radial distance from the centerline. In this regard, overextension is to be avoided due to the possibility of an adverse bending force which might be otherwise applied to a contact leaf 14 and damage or break it.

In addition to the two contact leaves 14, 14 at the forward end of the tailcap insert 10, four spring retainer leaves 17 are provided. As shown in FIGS. 1, 3 and 4, a total of four spring retainers 17 are provided for the tailcap insert 10 and each spring retainer leaf 17 comprises a lower leg 18 and an upper leg 20.

Referring to FIG. 3 the tailcap end of barrel 22 is shown having barrel counterbore 36, a portion of a battery 56, a tailcap 24, and tailcap insert 10. Also, shown in compression, is conventional conical tailcap spring 28, one-way flow seal 40, lanyard hole 26, and vent slot 46. Although a conical spring is preferred, and shown in FIG. 3, other types and shapes of springs may be used, such as for example, a straight, tubular spring, as long as the spring performs its function of exerting spring force between the battery and the tailcap to force the batteries forward and the insert wings radially outward.

In its assembled condition, as shown in FIG. 3, the tailcap 24 screws into the tail end of barrel 22 at barrel threads 30 and tailcap threads 32. As further shown in FIG. 3, the compressive force exerted on spring 28 by the action of battery 56 and tailcap 24 applies force downward against the inner surface of wing portion 56 of each contact leaf 14, thus forcing its radially outermost portion into a tight mechanical fit up against the inner surface of the barrel 22 at barrel counterbore 36, and thus forming an electrical contact of enhanced certainty and reliability. Also, as shown in FIG. 3, each contact leaf 14 lamp retainer portion 38 then also exerts a radially directed inward force against lamp 50 which is positioned within the central cavity of tailcap 24 to thus further secure the spare lamp.

Also shown in cross-section in FIG. 3 is the one-way flow seal 40. As described hereinabove in regard to FIG. 2, the FIG. 3 cross-sectional view shows one-way seal 40 having a flexible portion 42 at its outer periphery and an open channel 44 extending away from the battery compartment, the channel 44 also having channel outer wall 52 and channel inner wall 54. Also shown in FIG. 3 is vent 46 cut in the tailcap and adjacent to and immediately rearward of the seal flexible portion 42. When assembled, the seal 40 rests against the shoulder 58 and the face 60 of the tailcap 24.

The one-way seal of the present invention replaces the conventional 0-ring located at the tailcap end of a conventional flashlight. Although it is preferred that the one-way flow seal of the present invention be placed in the tailcap region of the flashlight to provide a one-way seal between the inside and outside of the flashlight battery compartment, it is envisioned that a seal of the present invention could be located at another location, such as, for example, at the head region of the flashlight in order to provide equivalent outgassing and prevention of contaminant ingress.

Also, although the one-way seal is disclosed in conjunction with flashlights of the type generally having AA sized batteries or smaller, such as AAA or AAAA, the one-way seal of the present invention may be usefully employed in flashlights using virtually any size and type of battery, specifically such as C and D-cell sizes.

As may be appreciated, the one-way flow seal of the present invention is preferably of a plastic or flexible material having sufficient flexibility to enable the seal flexible portion 42 to extend radially inward upon a predetermined over pressure condition within the battery housing to permit outgassing to occur, and to respond to any pressures generated by foreign material, whether solid, liquid or gaseous, entering vent 52 and applying pressure radially outward from within channel 44. The one-way seal of the present invention may be made, for example, with buna-n, natural or synthetic rubber, or other known materials used in the manufacture of 0-rings or conventional seals.

It is also noted that, depending upon the type of battery used in the flashlight, the particular nature of the outgas produced during battery operation may influence the choice of material of construction used in the seal, so that adverse chemical reactions are prevented.

Referring to FIG. 4, a cross-sectional view of the FIG. 1 preferred embodiment tailcap insert taken along lines A—A and, in pertinent part, B—B of FIG. 1 clearly illustrates the wing portion 56 and the distal ends 15 of each leaf 14, showing the upward and radially extending outward direction of wing portion 56. Behind and radially within wing portion 56 is shown the contact leaf lamp retainer portion 38 and also extending in a forward direction from the forward end of the main body 11 of the tailcap insert 10 are shown two of the spring retainer leaves 17. Referring to FIG. 4, the slightly bent shape of the spring retainer leaves 17 formed by the lower legs 18 and upper legs 20 enable the conical tailcap spring 28 to be slipped around the plurality of contact leaf retainers 17 and then down to and flush with the inside surface of the wing portion 56 of contact leaf 14.

Upon removal of the tailcap from the barrel, the spring retainer leaves 17 exert a slight force radially outward from the tailcap insert centerline, to thus apply a retaining force against the lower, or rearward coils of the coil spring 28, as shown, for example, in cross-sectional view FIG. 3. Upon insertion of the tailcap, the spring 28 forces the wing portion 56 against the barrel 22.

FIG. 5 shows a rear view of the preferred tail cap 24 incorporating the presently disclosed invention. Other views of the external features of this tailcap may be seen in FIGS. 14–15 of U.S. Pat. No. 4,819,141, which is herein incorporated by reference in its entirety.

Figure 6:
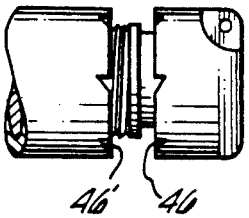
FIG. 6 is a side view illustrating alternate gas vents of the present invention.

FIG. 6 illustrates alternate forms of the gas vent feature of the present invention, whereby a plurality of sawtooth shaped vents 46, 46' are positioned around the entire circumference of the end of the barrel 22 and the tailcap 24. Although in FIG. 6 the vents 46, 46' are shown fashioned on the barrel 22 and the tailcap 24, such vents could also conveniently be formed on the only tailcap itself as is preferred. Also, if the seal were placed at the head end of the barrel, the vents would be placed on the head of the barrel or at an appropriate location at the head region of the flashlight. Although a plurality of vents are shown, virtually any number will work, so long as there is at least one vent having an orifice dimension sufficient to permit flow of outgases from the interior of the battery housing to ambient. Referring to FIG. 6, preferred and alternate vents are shown at 46, 46', it being understood that it is preferred to place vents only on one component, such as either the tailcap, 46 or on the barrel, 46'.

Although the exact pressure, gas production rate and identity will vary from flashlight to flashlight and battery type to battery type, the gas discharge values are believed to be relatively small relative to the ability of a metal flashlight to contain pressure build up. Also, it is noted that the one-way flow seal of the present invention may be employed in not only conventional, dry-cell, non-rechargeable battery flashlights, but also in flashlights with rechargeable batteries.

Figure 7:
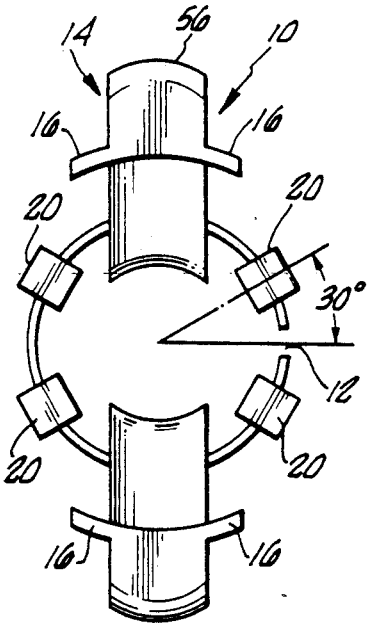
FIG. 7 is a front view of the tailcap insert of FIG. 1.

Referring to FIG. 7, a front view of the tailcap insert 10 of the present invention, the four contact leaf upper fingers 20, the two contact leaves 14 and wing portions 56, and the double, mutually opposed contact leaf retainer fingers 16 are shown to illustrate their respective radial positioning. As the tailcap assembly is rotated into the tailcap end of the barrel 22 it may be seen that the outermost edge 56 of the contact leaf 14 is forced radially outward, that is upward and downward as shown in FIG. 7, to enhance mechanical and therefore electrical contact between the tailcap insert 10 and the inside of the barrel 22 at counterbore 36. Also, it may be observed that upon placement of coil spring 28 on the tailcap insert 10, the four spring retainer leaves 17 would be initially compressed radially inward and, thereafter their inherent resiliency would provide a force radially outward, to thereby retain the spring on the tailcap during normal usage.

Again referring to FIG. 7, the double, mutually opposed contact leaf retainer portions 16 maybe seen to retain the wing portions 56 of contact leaf 14 from moving radially outward, that is upward and downward in FIG. 7, when the tailcap 24 is removed from the tailcap end of the barrel 22. In further reference to FIG. 7 and FIG. 3 it may be seen that these portions 38 butt up against tailcap counterbore 48.

While I have described preferred embodiments of the herein invention, numerous modifications, alterations, alternate embodiments and alternate materials of construction may be contemplated by those skilled in the art and may be utilized in accomplishing the present invention. It is envisioned that all such alternate embodiments are considered to be within the scope of the present invention as defined by the appended claims.

I claim:

1. An insert for a flashlight having a barrel, a lamp, a battery source of power, a spring electrically coupled to the battery source of power and a tailcap, said insert comprising:

a conductive metal insert positioned within the barrel, electrically coupling the barrel to the spring and having a body portion of tubular shape and of a size capable of containing a spare lamp bulb and a pair of arm members extending radially outward from the body portion and contacting the barrel to provide a conductive path between the barrel and the spring and further including means to force said arm members radially outward in response to coupling of the tailcap to the barrel.

2. The insert of claim 1 wherein the means to force includes the spring positioned between a rearmost battery and the tailcap.

3. The insert of claim 2 further including a plurality of resilient means for retaining the conical spring in attachment to said tailcap upon removal of said tailcap from said barrel.

4. The insert of claim 3 wherein the resilient means further includes a plurality of members, each of said members defining a first portion extending radially outwardly of said body portion, a second portion extending radially inwardly of said body portion, said portions bearing against said spring upon said tailcap being removed from aid barrel.

5. The insert of claim 4 further including means for preventing said pair of arm members from extending beyond a predetermined radial distance.

6. The insert of claim 5 wherein the means for preventing extension comprises a plurality of mutually opposed members extending from the distal end of each of said pair of arm members.

7. An insert for a flashlight having a barrel, a lamp, a battery source of power, a spring electrically coupled to the battery source of power and a tailcap, said insert comprising:

a conductive metal insert positioned within the barrel, electrically coupling the barrel to the spring and having a body portion of tubular shape and of a size capable of containing a spare lamp bulb and a pair of arm members extending radially outward from the body portion and contacting the barrel to provide a conductive path between the barrel and the spring and further including a plurality of resilient means for retaining the spring in attachment to said tailcap upon removal of said tailcap from said barrel.

8. The insert of claim 7 where the spring comprises a conical spring.

9. The insert of claim 7 where the spring comprises a cylindrical spring.

10. The insert of claim 7 wherein the resilient means further includes a plurality of members, each of said members defining a first portion extending radially outwardly of said body portion, a second portion extending radially inwardly of said body portion, said portions bearing against said spring upon said tailcap being removed from said barrel.

11. The insert of claim 1 further including means for preventing said pair of arm members from extending beyond a predetermined radial distance.

12. The insert of claim 11 wherein the means for preventing extension comprises a plurality of mutually opposed members extending from the distal end of each of said pair of arm members.

13. A flashlight including a barrel, a lamp, a battery source of power, an electrical circuit including a switch for turning the flashlight on and off and a housing, the improvement comprising:

means to permit one-way flow of gases from the inside of the housing to ambient and to prevent the ingress of materials from ambient to the interior of the battery housing, said means for providing one-way flow comprising a flexible seal having a generally donut-shaped configuration with an open-ended channel formed therein having a channel outer wall and a channel inner wall and a channel forward wall whereby said channel outer wall rests against a first portion of said housing and said channel inner wall rests against a second portion of said housing;

means to vent gas flowing through said flexible seal from the interior of the housing to ambient, said means to vent comprising a plurality of slots positioned along the periphery of the tailcap end of the barrel.

14. A flashlight including a lamp, a battery source of power, an electrical circuit including a switch for turning the flashlight on and off, the improvement comprising:

a housing including a barrel having an open tail end with internal threads and an end cap having external threads to mate with said internal threads, a circumferential shoulder to engage the end of said barrel and an annular groove between said external threads and said circumferential shoulder;

a generally donut-shaped flexible seal including an open ended channel formed therein defined by a channel outer wall, a channel inner wall and a channel forward wall whereby said channel outer wall extends against said barrel, said channel inner wall extends against said end cap and said forward wall is disposed in said annular groove toward said external threads;

passage means through at leas tone of said barrel and said end cap venting a portion of said annular groove between said flexible seal and said shoulder.

15. The flashlight of claim 14 wherein said passage means includes at least one slot cut through said shoulder.

16. The flashlight of claim 13 wherein said passage means includes at least one slot cut in the end of said barrel.

17. The flashlight of claim 13 wherein said passage means includes slots cut in said shoulder and the end of said barrel.

* * * * *